US006105816A

United States Patent [19]

Shea

[11] Patent Number: 6,105,816

[45] Date of Patent: Aug. 22, 2000

[54] PAINTER'S AID

[76] Inventor: Donald L. Shea, 708 Georgia Ave., Statesville, N.C. 28677

[21] Appl. No.: 09/309,028

[22] Filed: May 10, 1999

Related U.S. Application Data

[63] Continuation-in-part of application No. 08/831,059, Apr. 1, 1997.

[51] Int. Cl.[7] ..... B05C 21/00; B05D 25/00

[52] U.S. Cl. ..... 220/697; 206/362.3; 220/571; 220/669; 220/675; 220/736

[58] Field of Search ..... 220/697, 570, 220/695, 698, 700, 702, 735, 736, 789, 790, 675, 669; 15/146, 147.2, 184, 248.1; 206/81, 1.7, 1.8, 1.9, 361, 362.3, 15.3; 73/426; 222/572, 566

[56] References Cited

U.S. PATENT DOCUMENTS

| | | | |
|---|---|---|---|
| Re. 35,933 | 10/1998 | Scholl | 220/695 |
| 2,271,822 | 2/1942 | Hills | 222/572 |
| 2,786,614 | 3/1957 | Giusto | 220/697 |
| 3,395,828 | 8/1968 | Schnabel | 220/697 |
| 3,980,213 | 9/1976 | Ramsay | 220/700 |
| 4,164,299 | 8/1979 | Fuhr | 220/697 |
| 4,203,537 | 5/1980 | McAlister | 220/675 |
| 4,225,064 | 9/1980 | Westcott | 220/695 |
| 4,771,501 | 9/1988 | Leiter | 206/361 |
| 4,927,046 | 5/1990 | Armstrong | 220/697 |
| 5,137,316 | 8/1992 | Foos | 73/426 |
| 5,568,879 | 10/1996 | Kovathana | 220/697 |
| 5,893,489 | 4/1999 | Giarrante | 220/695 |
| 5,971,201 | 10/1999 | Daw | 220/697 |

*Primary Examiner*—Allan N. Shoap
*Assistant Examiner*—Niki M. Eloshway
*Attorney, Agent, or Firm*—Dougherty & Associates

[57] ABSTRACT

A painter's aid for sealably holding paint and for holding a paint brush having a brush portion and a handle portion. The painter's aid has a base, a wall extending upwardly from the base, the wall comprising a front interior portion, a rear interior portion and a pair of opposing side wall portions tapering outwardly from the base and connecting the front interior portion and the rear interior portion, a lid engaging rim opposite the base and integral with the wall, a platform for supporting the brush portion of the paint brush, the platform being generally parallel to the base and extending outwardly from the lid engaging rim and a raised lip for supporting the handle portion of the paint brush, the lip being integral with the lid engaging rim and integral with and substantially upright to said platform, the lip having an opening therethrough adjacent the lid engaging rim and opposite said platform, and preferably includes a stepped wiping surface.

20 Claims, 14 Drawing Sheets

PAINTER'S AID

CROSS-REFERENCE TO RELATED APPLICATION

This application is a continuation-in-part of U.S. application Ser. No. 08/831,059, filed Apr. 1, 1997.

FIELD OF THE INVENTION

The present invention relates to a device for containing paint, and more particularly to a device that permits easy storage of paint and substantially dripless painting.

BACKGROUND OF THE INVENTION

The instant invention relates generally to painting tools and more specifically to a paint holder.

Applicant is aware of the following U.S. patents concerning painting aids.

| U.S. Pat. No. | Inventor | Issue Date | Title |
|---|---|---|---|
| 2,418,502 | R. O. Ferguson | 04-08-1947 | CONTAINER AND SCRAPING DEVICE THEREOF |
| 2,873,881 | F. C. Nichols | 02-17-1959 | CONTAINER RIM PROTECTOR |
| 2,941,692 | E. L. Kappel | 06-21-1960 | BRUSH REST AND WIPER FOR PAINT CAN |
| 2,988,768 | R. W. Hill | 06-20-1961 | SUPPORT FOR LIQUID APPLICATOR |
| 3,463,366 | F. D. Spencer | 08-26-1969 | PAINT CAN ATTACHMENT RING WITH POURING LIP |
| 3,595,431 | F. L. Bird | 07-27-1971 | DRIPLESS PAINT CONTAINER |
| 4,125,210 | M. J. Embree | 11-14-1978 | ATTACHMENT FOR PAINT CANS |
| 4,203,537 | G. McAlister | 05-20-1980 | PAINT CAN ACCESSORY |
| 4,860,891 | R. Biggio | 08-29-1989 | PAINT & BRUSH HOLDER |
| 4,927,046 | R. B. Armstrong | 05-22-1990 | HOLDING VESSEL WITH SUPPORTIVE HANDLE |
| 5,054,661 | A. K. Hollje | 10-08-1991 | PAINT BUCKET CONSTRUCTION |
| 5,549,216 | Robert Scholl | 08-27-1996 | PAINT HOLDER AND DELIVERY DEVICE |

Ferguson, U.S. Pat. No. 2,418,502, relates to a container for paint and other liquid materials applied with the brush and more particularly to containers of this type in which the paint or other material is retained within the receptacle during application there of.

Nichols, U.S. Pat. No. 2,873,881, discloses a rim protector for paint cans.

Kappel, U.S. Pat. No. 2,941,692, relates generally to devices adapted to be associated with paint cans and the like, and more specifically to a wiping surface and a brush support combination.

Hill, U.S. Pat. No. 2,988,768, relates generally to a support for applicators, such as paint brushes, and more particularly, to a means for removably mounting one or more liquid applicators, in a conveniently accessible position relative to a liquid container such as a paint can or pail.

Spencer, U.S. Pat. No. 3,463,366, teaches a paint can attachment ring with pouring lip wherein paint is prevented from accumulating in the gutter of a paint can brim by an attachment ring having a depending skirt which carries a first annular shoulder adapted to engage the inner periphery of the brim on a first size paint can and a second, thicker annular shoulder adapted to engage the inner periphery of the brim of a second sized paint can.

Bird, U.S. Pat. No. 3,595,431, teaches a dripless paint container made offour bosses molded integral with the inside of a plastic paint container, two on each side, provided with grooves in the top thereof to receive two snap in wire rods in diametrically opposed parallel relation to serve as wipers for the brushes enabling drainage of excess paint therefrom without any spillage.

Embree, U.S. Pat. No. 4,125,210, teaches an attachment for paint cans, the attachment comprising an annular collar adapted for snap-fit engagement with the rim of a paint can, the collar having an annular floor portion and a wall portion upstanding therefrom, a brush portion extending from the collar in a first direction and a spout portion extending from the collar in a second direction, and a cover member engagable with interior portions of the collar and operable to close the opening therein.

McAlister, U.S. Pat. No. 4,203,537, teaches a paint can accessory for mounting on the rim of a paint can. An annular ring is dimensioned to cover the rim channel of a conventional paint can. A pouring spout integral with the ring extends radially therefrom. The spout includes a substantially planar surface capable of supporting a paint brush. A leveraging means depending from the pouring spout permits force to be applied along the ring to remove the accessory from the can.

Biggio, U.S. Pat. No. 4,860,891, teaches a paint and brush holder having an elongated housing for supporting a paint brush in a vertical position over a paint reservoir base with paint brush bristles facing downwardly so that in one situation paint can drip from the bristles backing to the paint reservoir base and in the second situation, paint covers the bristles to keep them moist when the paint brush is not being used.

Armstrong, U.S. Pat. No. 4,927,046 teaches a holding vessel with a supportive handle for carrying liquids or other loose materials including a generally pentagonal hollow body. The body of the vessel has an open top, convenient pouring spouts and supportive handle which is an integral part of the lower half of one side of the body. The inner cavity of the body of the vessel is formed into a ledge at the top of the handle which, in connection with the notch spout directly opposite, provides an excellent paint brush holder. Three ridges in the bottom, aid in cleaning one's paint brush like a washboard and also serves as a grip for the user's fingers.

Hollje, U.S. Pat. No. 5,054,661, teaches a paint bucket construction defining a cylindrical container including a support projection formed with an interior cavity directed orthogonally upwardly from an upper edge of the container, wherein the projection includes a handle axially offset relatively to the container axis and a forward portion of the projection aligned in a common plane with the axis of the container.

Scholl, U.S. Pat. No. 5,549,216, teaches a paint holder and delivery device. A disposable insert fits within the container to facilitate the application of paint with a paint brush.

SUMMARY OF THE INVENTION

The invention provides an apparatus for aiding a painter.

In the preferred embodiment, the painter's aid has a base and a wall extending upwardly from the base. The wall has a front interior portion which is substantially curved. A pair of opposed side wall portions are tapered outwardly from the base. A rear interior portion of the wall is connected to the front interior portion by the opposing tapered side walls, preferably, the rear interior portion is substantially flat. A lid engaging rim is integral with the wall and opposite with the base. A platform is preferably generally parallel to the base and extending outwardly from the lid engaging rim. A raised lip supports the handle of a paint brush while the platform supports the bristles. In a preferred embodiment, the lip has an opening to facilitate paint pouring.

The lid engaging rim may sealably receive a conventional paint can lid or a lid having tongue that, in operation, is sealably received by the opening of the lip.

OBJECTS OF THE INVENTION

The principal object of the present invention is to provide an improved device that facilitates dripless painting.

A further object of this invention is to provide a device that includes a wiping surface to remove excess paint from a paint brush.

Another objective of this invention is to provide a sealable device for storing paint.

BRIEF DESCRIPTION OF THE DRAWINGS

The foregoing and other objects will become more readily apparent by referring to the following detailed description and the appended drawings, in which.

DETAILED DESCRIPTION

Figure 1:
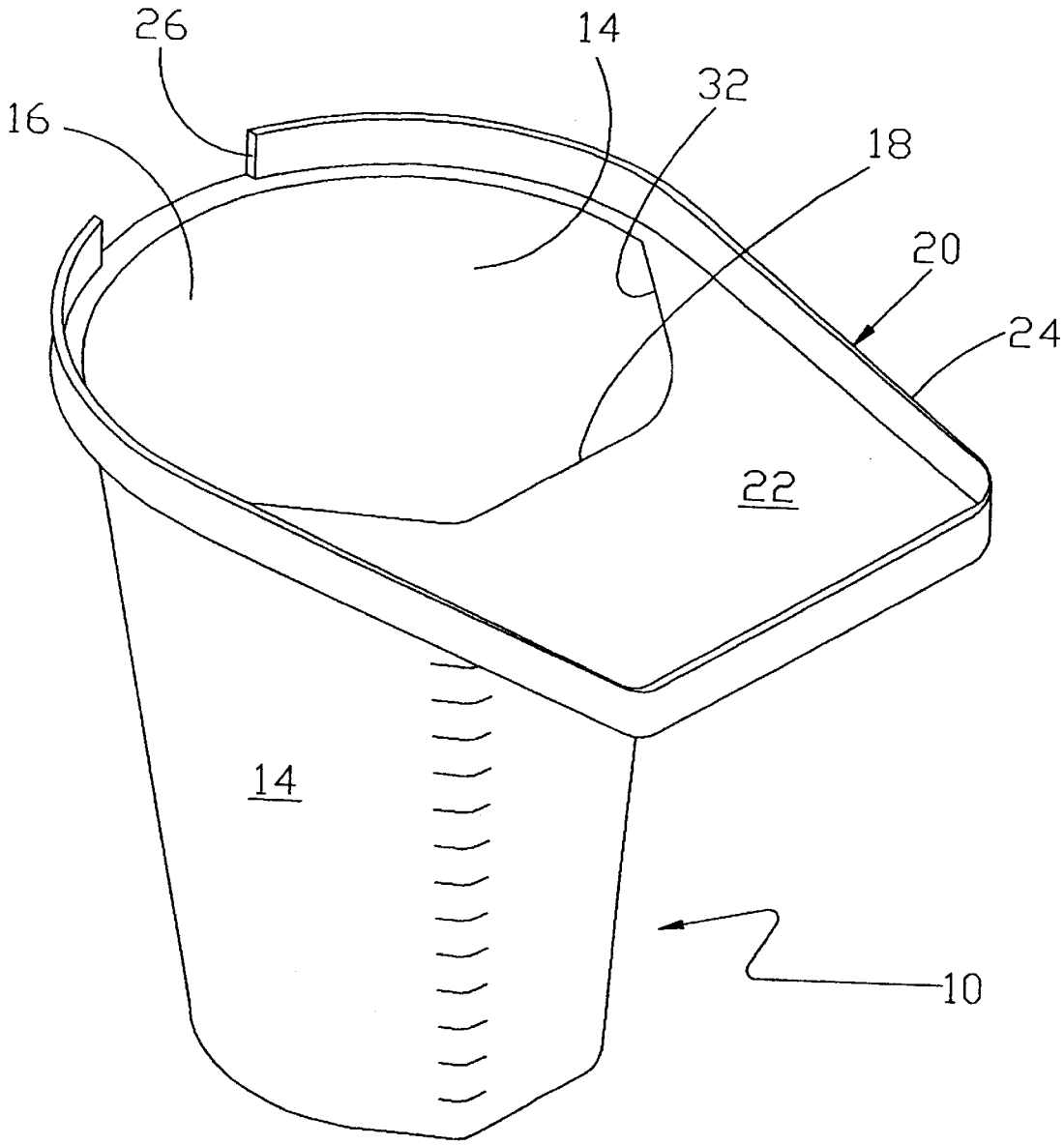
FIG. 1 is an isometric view of one embodiment of the invention.
Figure 2:
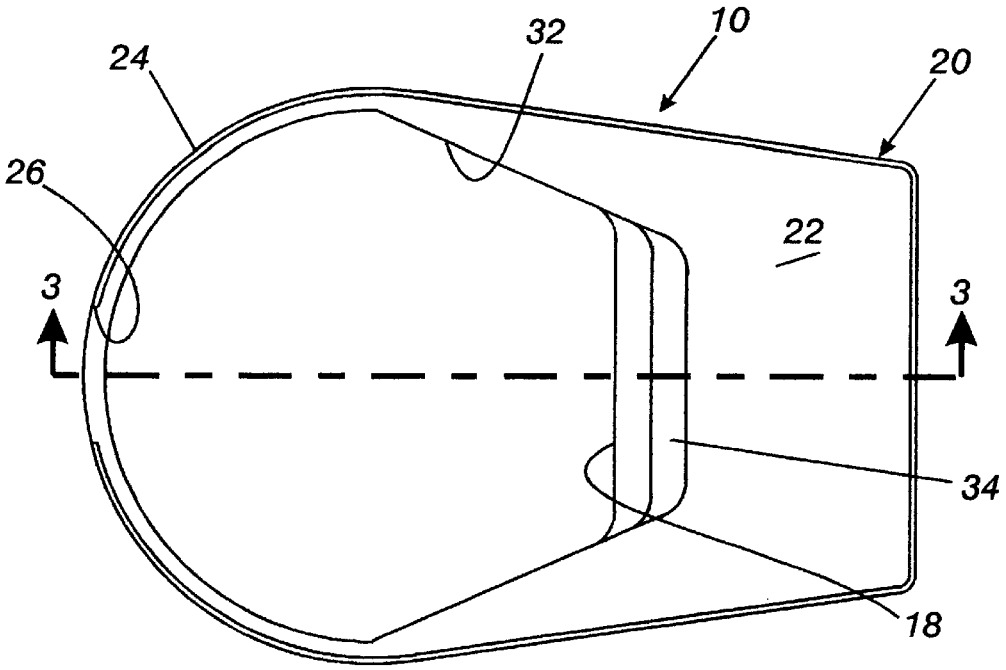
FIG. 2 is a top view of the invention as shown in FIG. 1.
Figure 3:
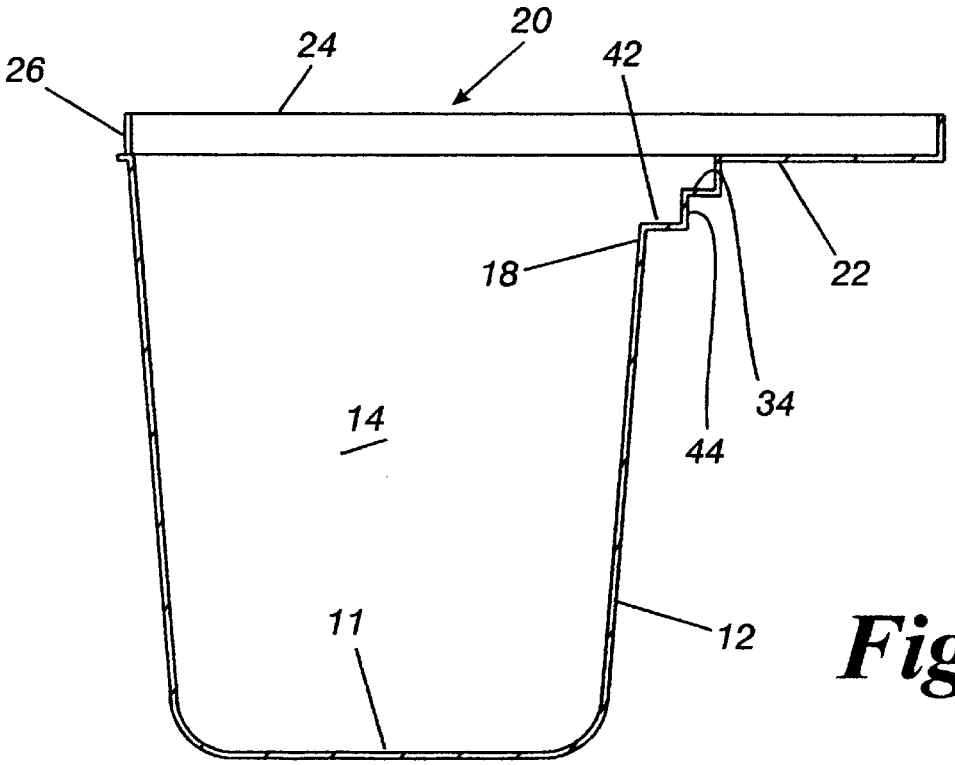
FIG. 3 is a cross-sectional view of the invention taken alone lines 3—3 of FIG. 2.

Referring now to the drawings, and particularly to FIGS. 1, 2 and 3, the painter's aid 10 includes a base 11, a wall 14 upstanding from the base, and an upper brush support portion 20.

preferably, base 11 is substantially flat. Wall 14 typically extends upwardly from base 11 and wall 14 includes a front interior portion 16, a rear interior portion 18 and a pair of opposed side wall portions 32 tapered outwardly as they rise from base 11 and connecting the front interior portion 16 and the rear interior portion 18.

In the preferred embodiment, opposing side walls 32 are tapered at a 15° C. angle from or relative to front interior portion 16.

Figure 15:
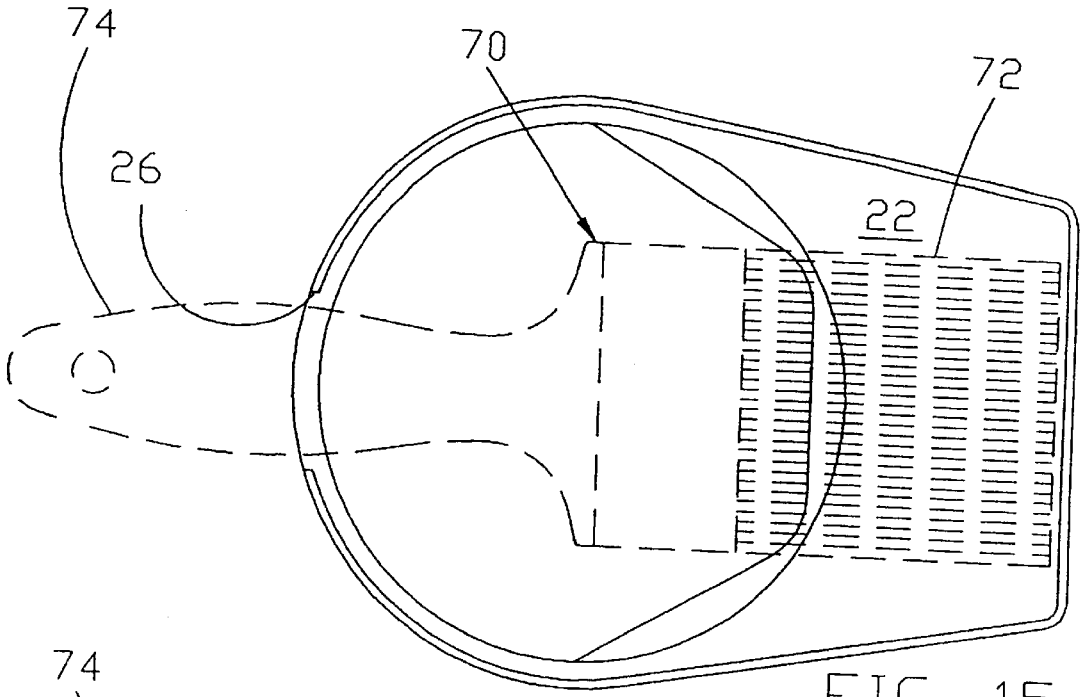
FIG. 15 is a top view of the embodiment of FIG. 5 supporting a conventional paint brush.
Figure 16:
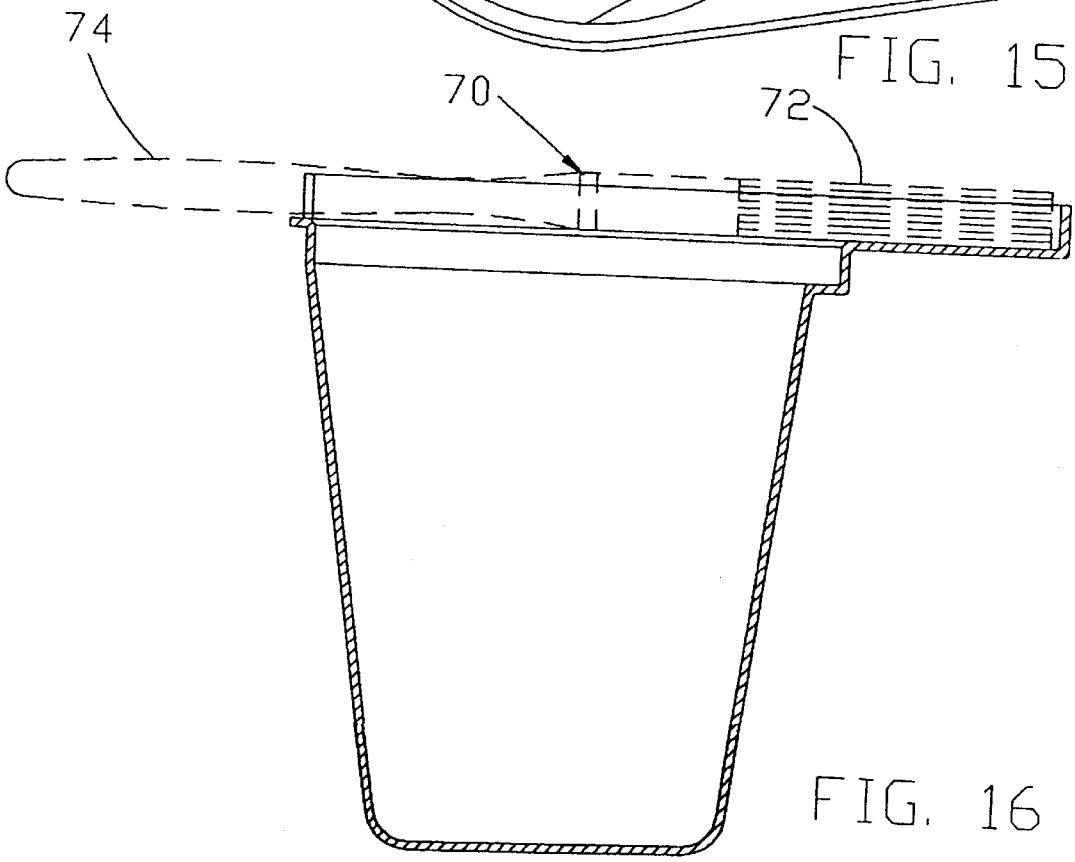
FIG. 16 is a cross-sectional view of FIG. 15 supporting a paint brush.

Upper portion 20 includes platform 22, raised lip 24 and lip opening 26. platform 22 supports the brush portion 72 of a paint brush 70, as seen in FIGS. 15 and 16. In addition, opening 26 supports the handle portion 74 of paint brush 70, as seen in FIGS. 15 and 16.

Figure 5:
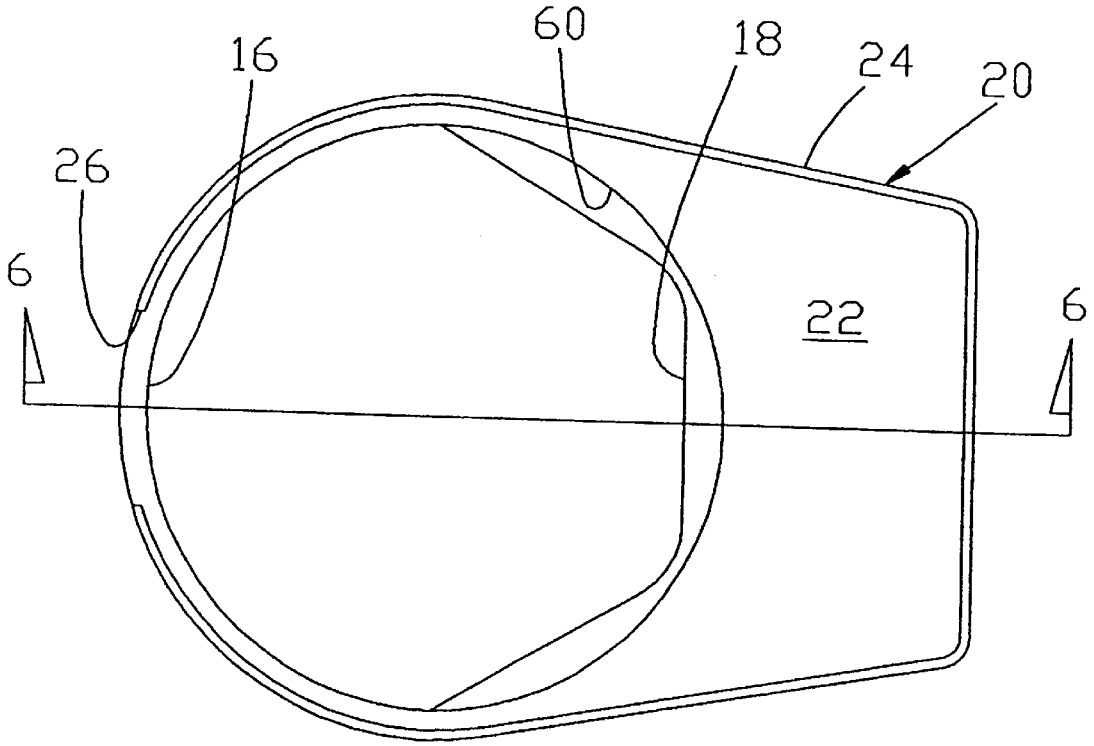
FIG. 5 is a top view of the embodiment of the invention shown in FIG. 4.
Figure 4:
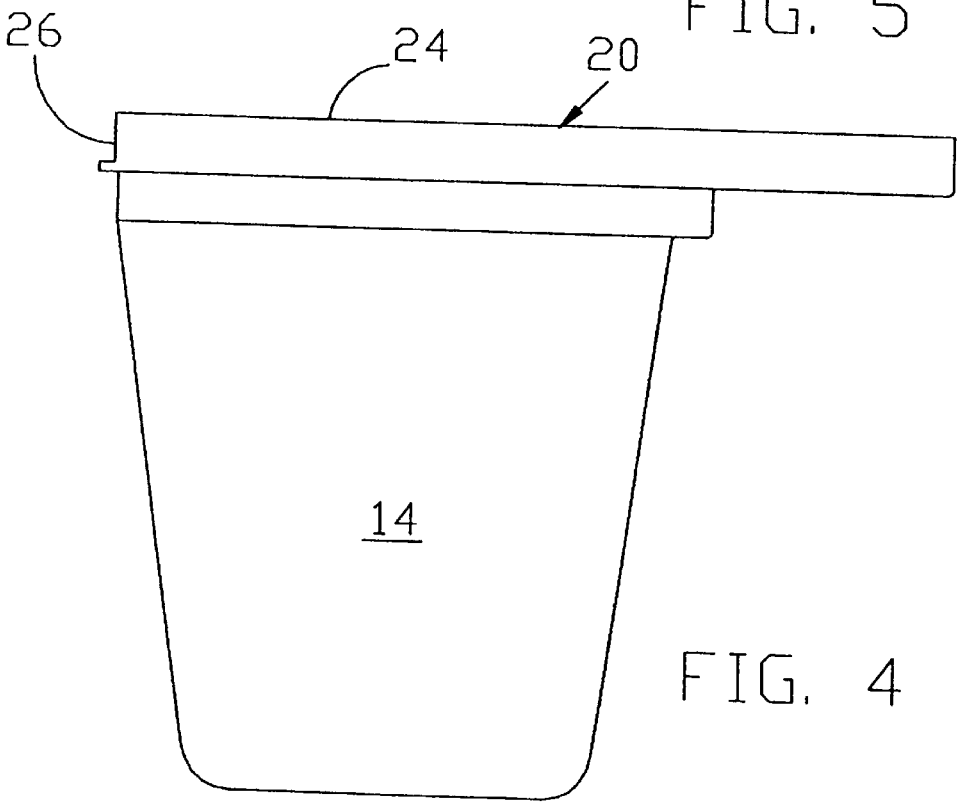
FIG. 4 is a side view of an alternative embodiment of the present invention.
Figure 6:
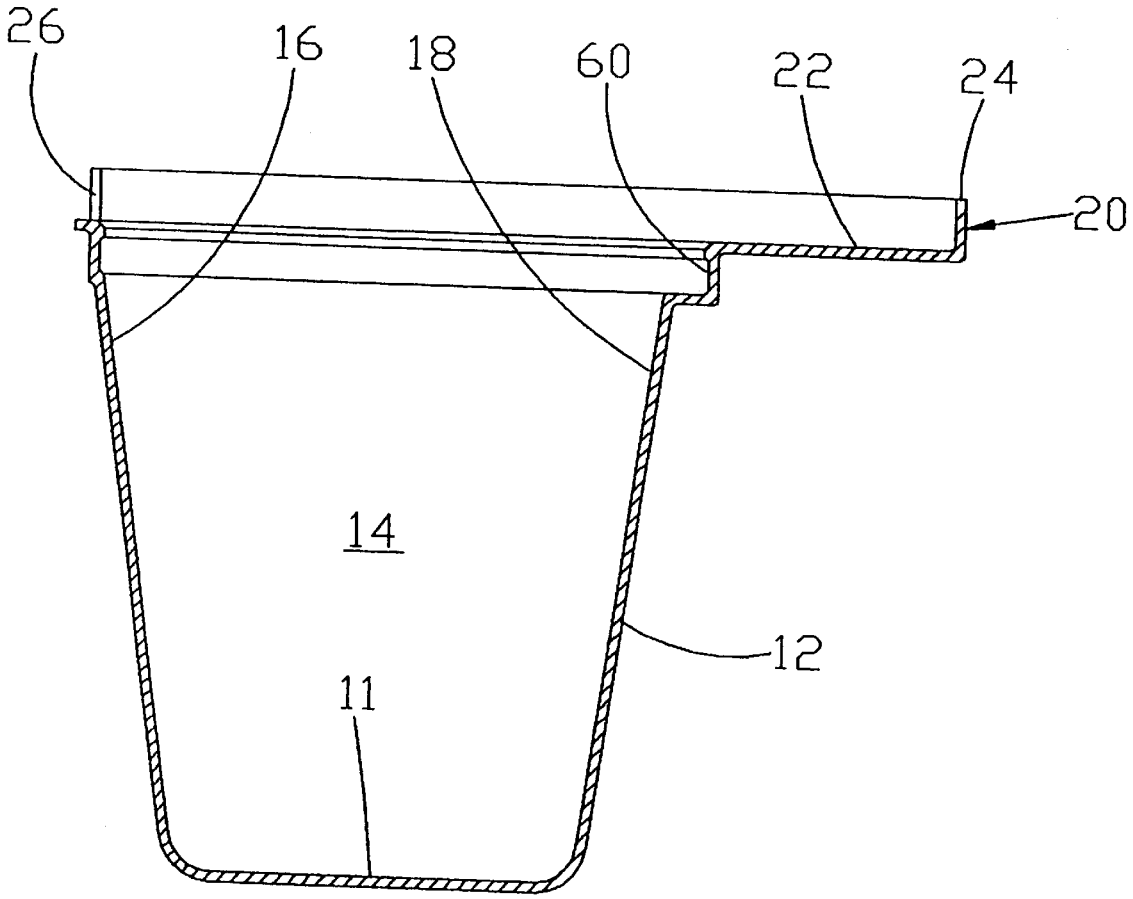
FIG. 6 is a cross-sectional view taken along line 6—6 of FIG. 5.

Referring now to FIGS. 4, 5, and 6, an alternative embodiment of the painter's aid for sealably holding paint and for retaining a paint brush has a base 11, and a wall 14 extending upwardly from base 11. Wall 14 includes a front interior portion 16, a rear interior portion 18 and a pair of opposing side wall portions 32 tapered outwardly from base 11 and connecting front interior wall 16 and rear interior portion 18. As shown in FIGS. 2–6, the wall 14 connecting to rear interior portion 18, has an upper step 34 that is adjacent to the platform 22 of the upper portion 20.

Figure 11:
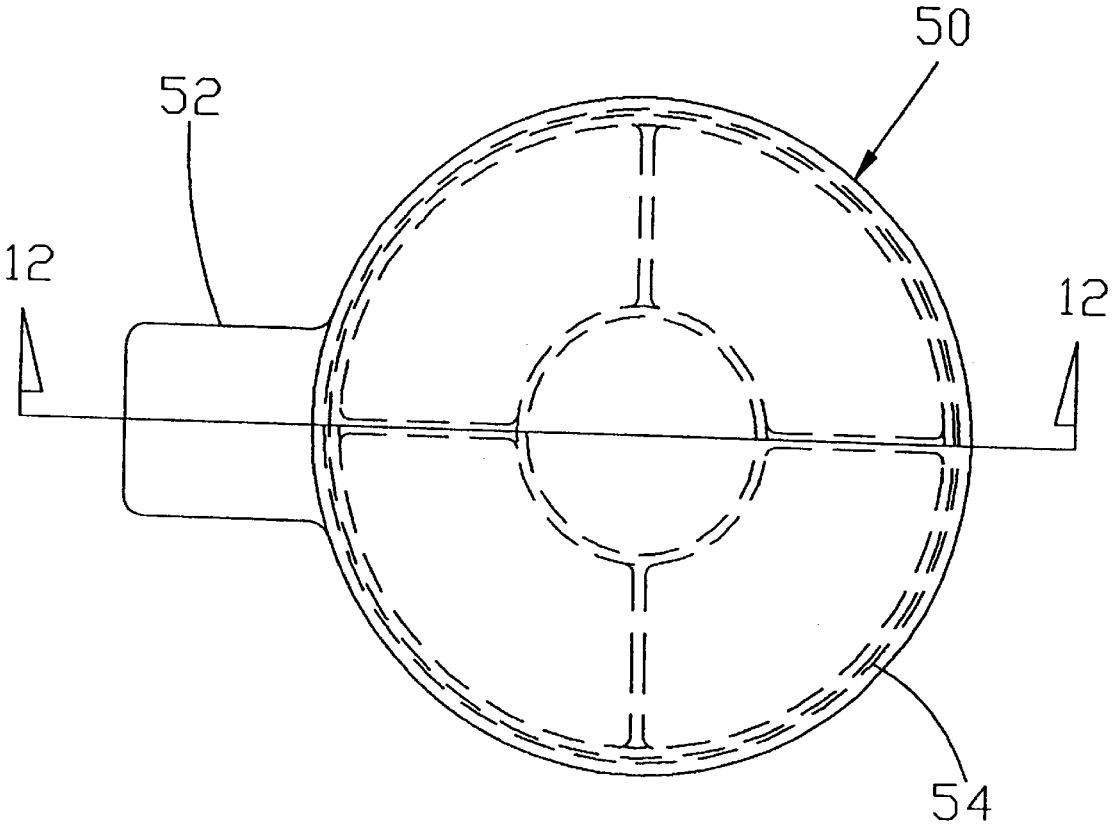
FIG. 11 is a top view of a lid for the present invention.
Figure 12:
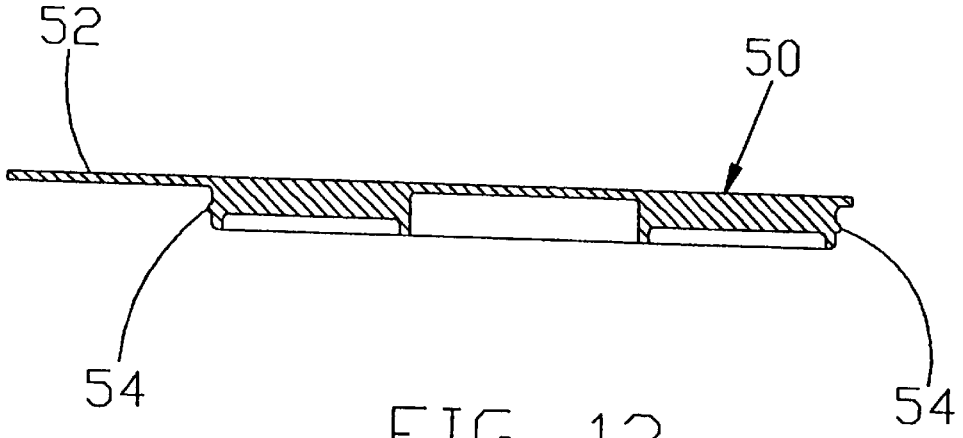
FIG. 12 is a cross-section view of the lid of FIG. 11.
Figure 13:
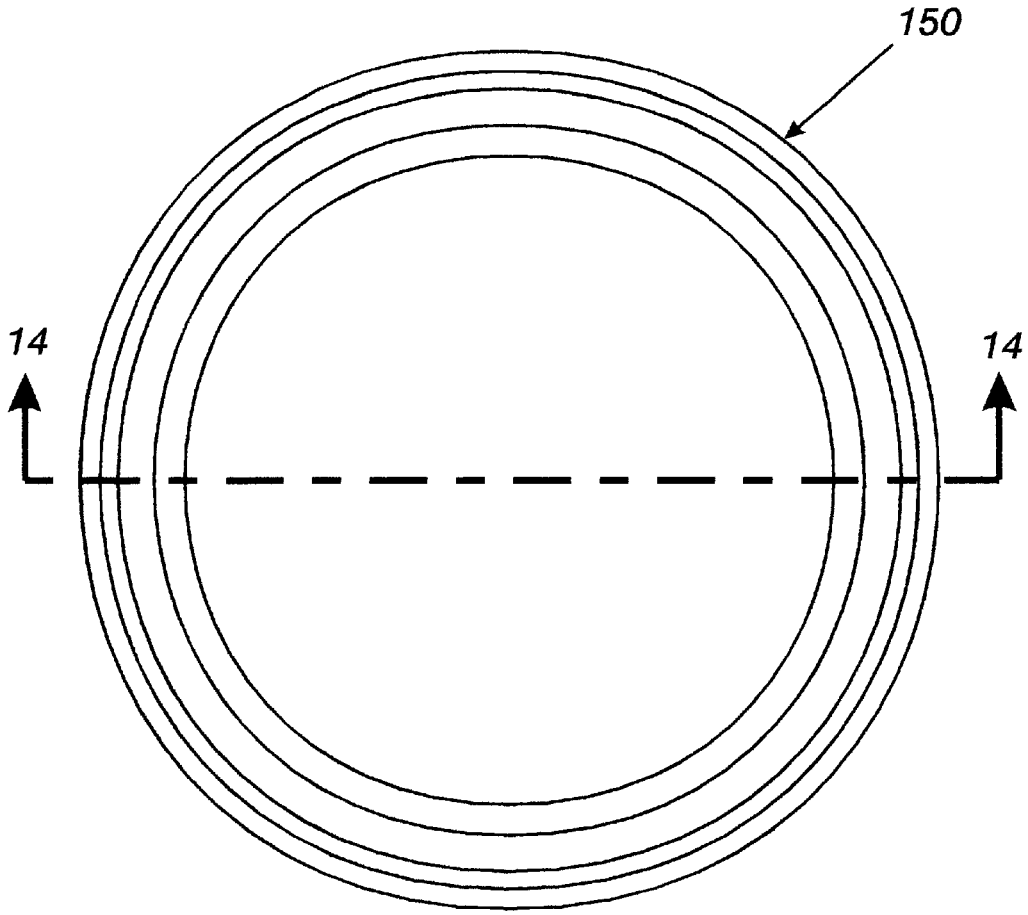
FIG. 13 is a top view of a conventional paint can lid.
Figure 14:
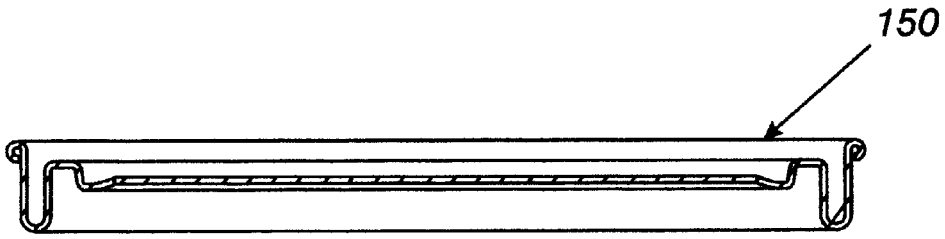
FIG. 14 is a cross-sectional view of the conventional paint can lid of FIG. 13.

The alternative embodiment of the present invention 10 seen in FIGS. 4, 5 and 6 also includes a lid engaging rim 60 opposite base 11 and integral with wall 14. platform 22 supports the brush portion 72 of a paint brush 70. platform 22 is generally parallel to base 11 and extends outwardly from lid engaging rim 60. Raised lip 24 forms a pan with upper portion 20 to prevent paint dripping. Lip 24 is integral with and substantially upright from platform 22. Lip 24 has an opening 26 therethrough adjacent to the lid engaging rim 60 and opposite from platform 22 for receiving a paint brush handle. Lid engaging rim 60 has a diameter sized to receive either the painter's aid lid 50 seen in FIGS. 11 and 12 or a conventional paint can lid 150 seen in FIGS. 13 and 14. As shown in FIGS. 11 and 12, painter's aid lid 50 has a protruding extension 52 adjusted to cover opening 26 in lip 24. Lid 50 also has an annular ridge 54 which may engage the lid engaging rim 60 and form a tight seal.

The rear interior portion 18 and tapered opposing side walls 32 cooperatively force the brush portion 72 of a conventional paint brush 70 inboard and push the paint toward the center and top surface of the brush portion 72; as paint brush 70 is withdrawn from painter's aid 10 and brush portion 72 is wiped along rear interior portion 18.

Figure 7:
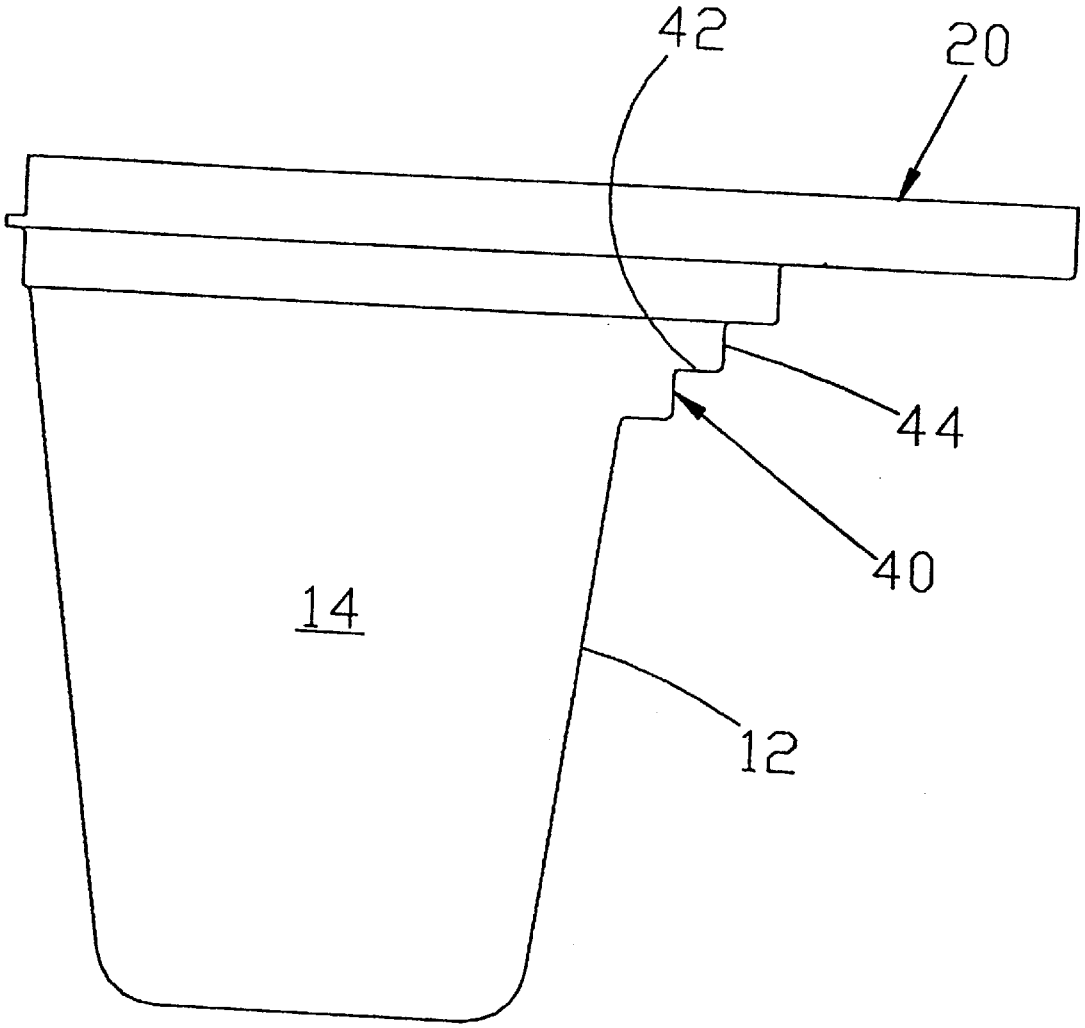
FIG. 7 is a side view of another alternative embodiment of the present invention.
Figure 8:
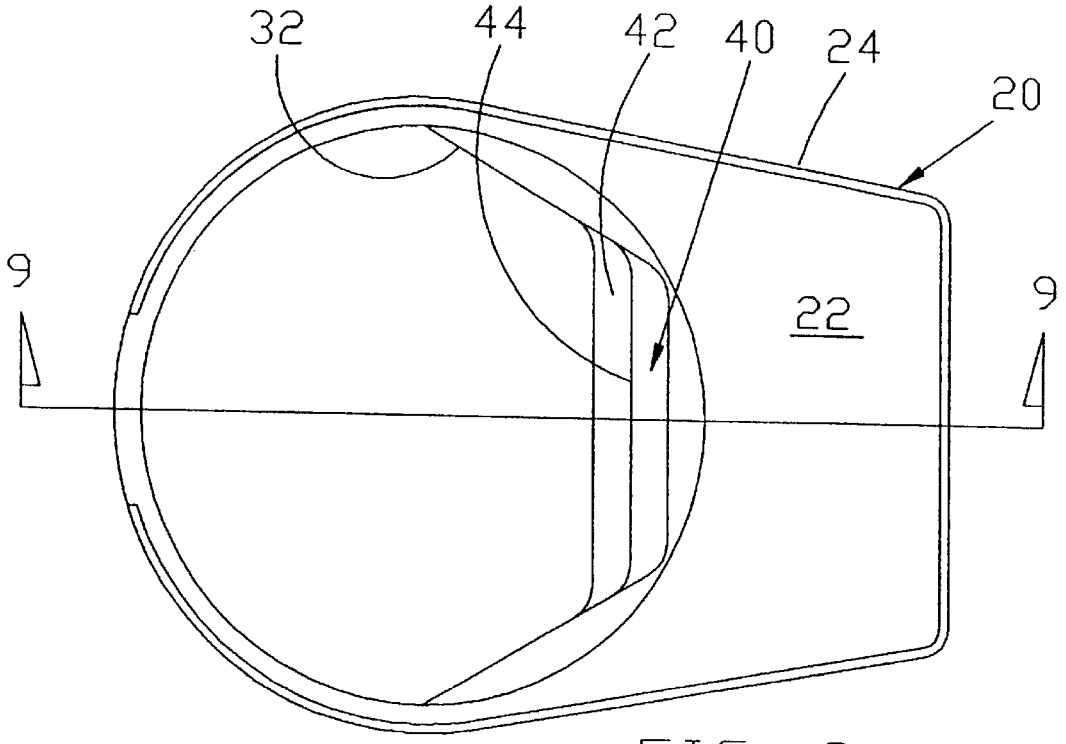
FIG. 8 is a top view of the alternative embodiment depicted in FIG. 7.
Figure 9:
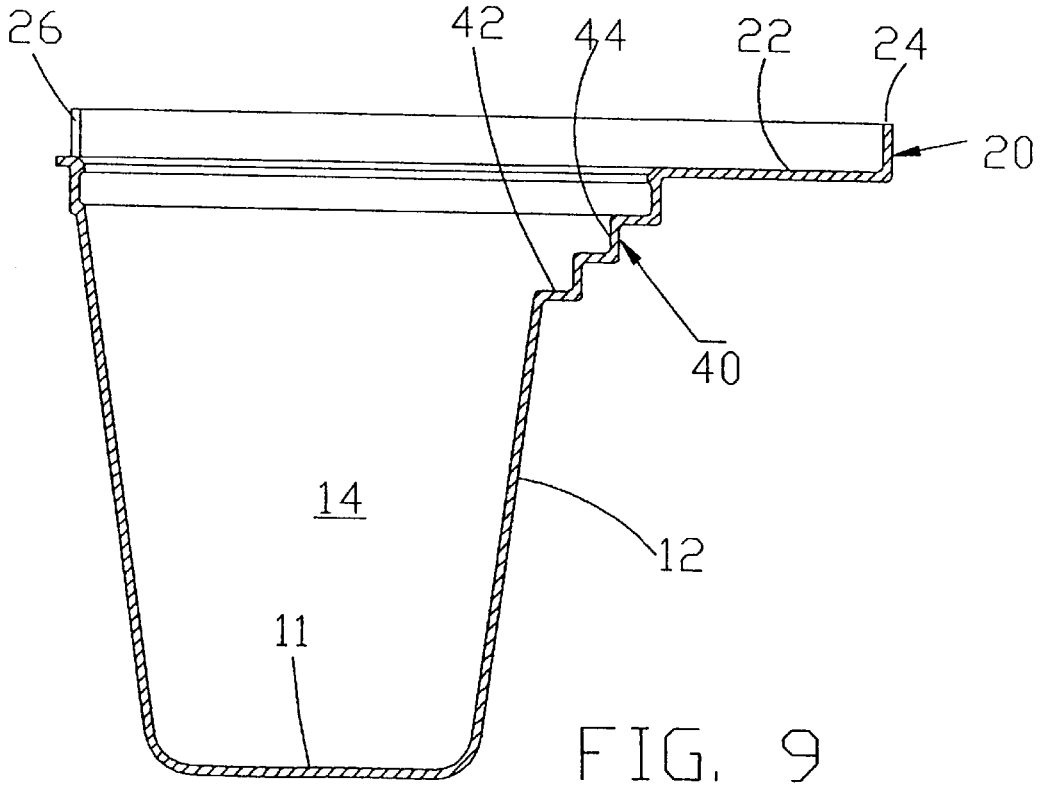
FIG. 9 is a cross-sectional view of the alternative embodiment of FIG. 8 taken along line 9—9 of FIG. 8.
Figure 10:
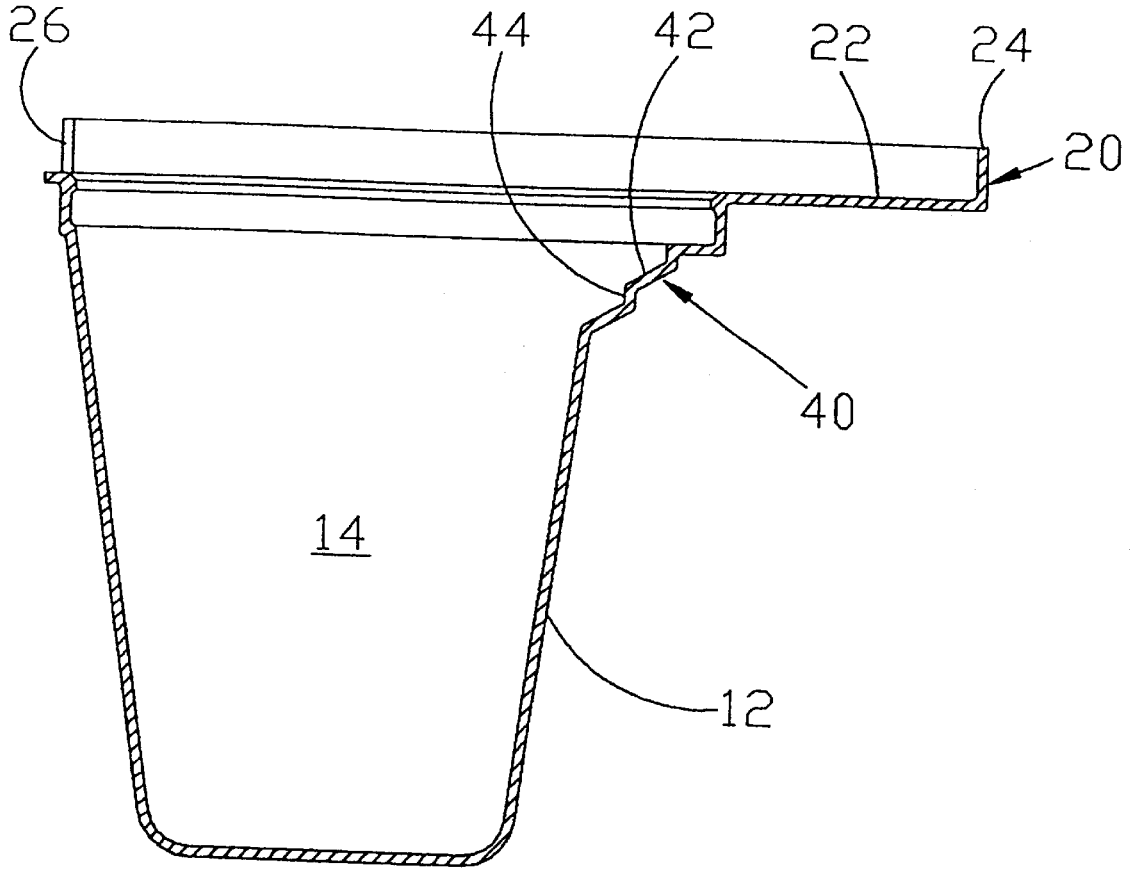
FIG. 10 is a cross-sectional view of an alternative embodiment of the present invention.

As seen in FIGS. 7, 8, and 9, the addition of stepped wiping surface 40 creates additional wiping surfaces which takes excess paint off the brush portion 72 of a paint brush 70. Stepped wiping surface 40 has steps 42 and risers 44. Steps 42 and risers 44 may be perpendicularly positioned as seen in FIGS. 7 and 9, or steps 42 may be inclined as seen in FIG. 10.

Figure 17:
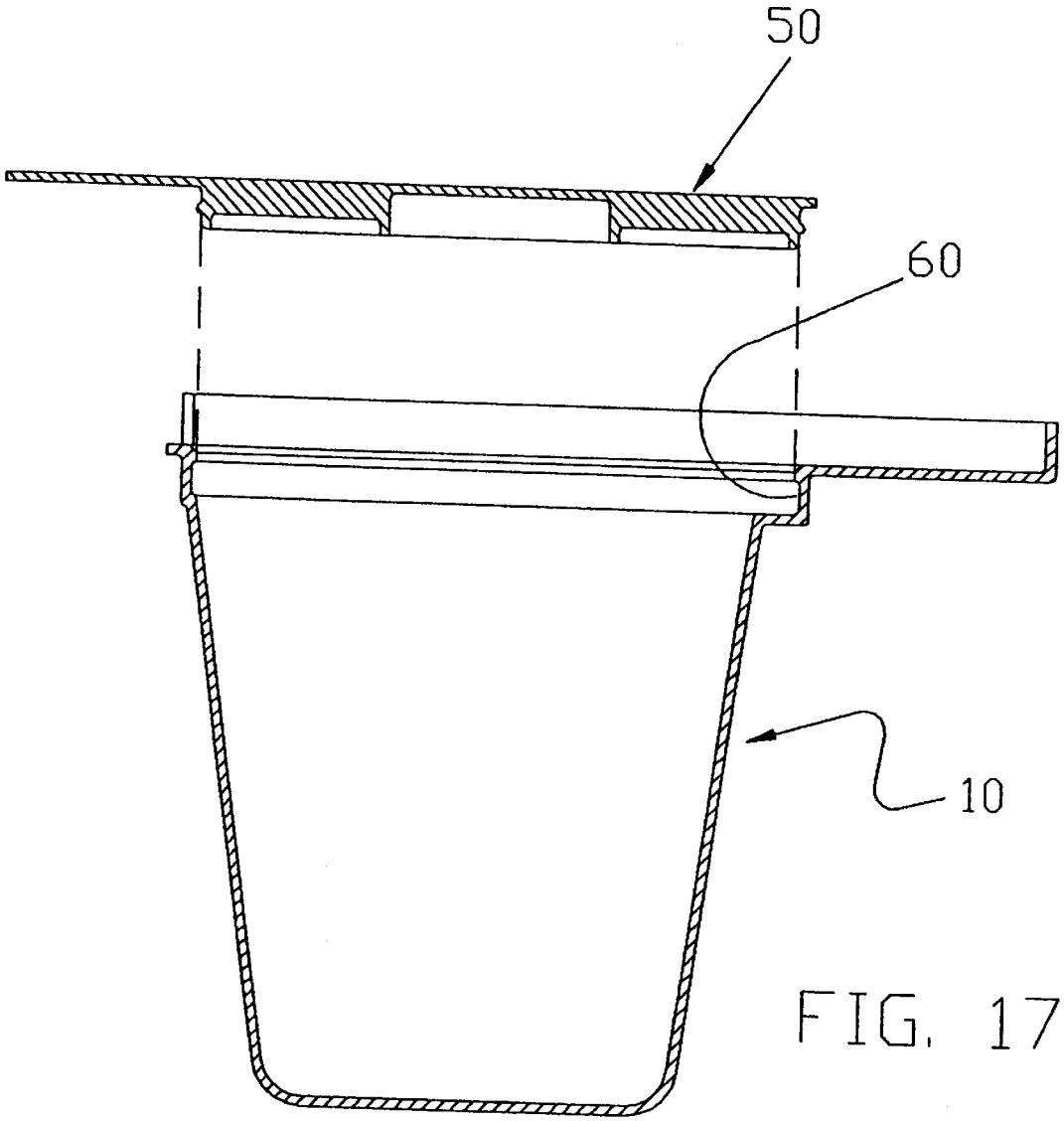
FIG. 17 is a cross-sectional view of an embodiment of the present invention utilizing a lid.
Figure 18:
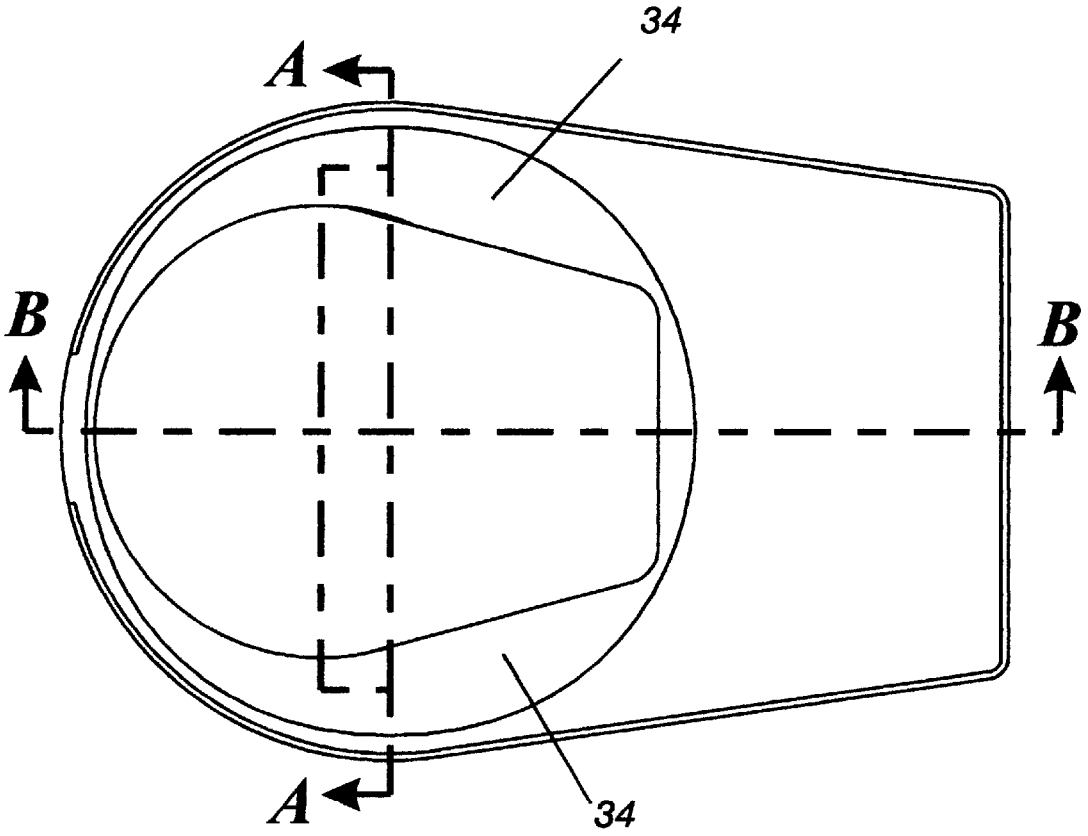
FIG. 18 is a top view of another alternative embodiment.
Figure 19:
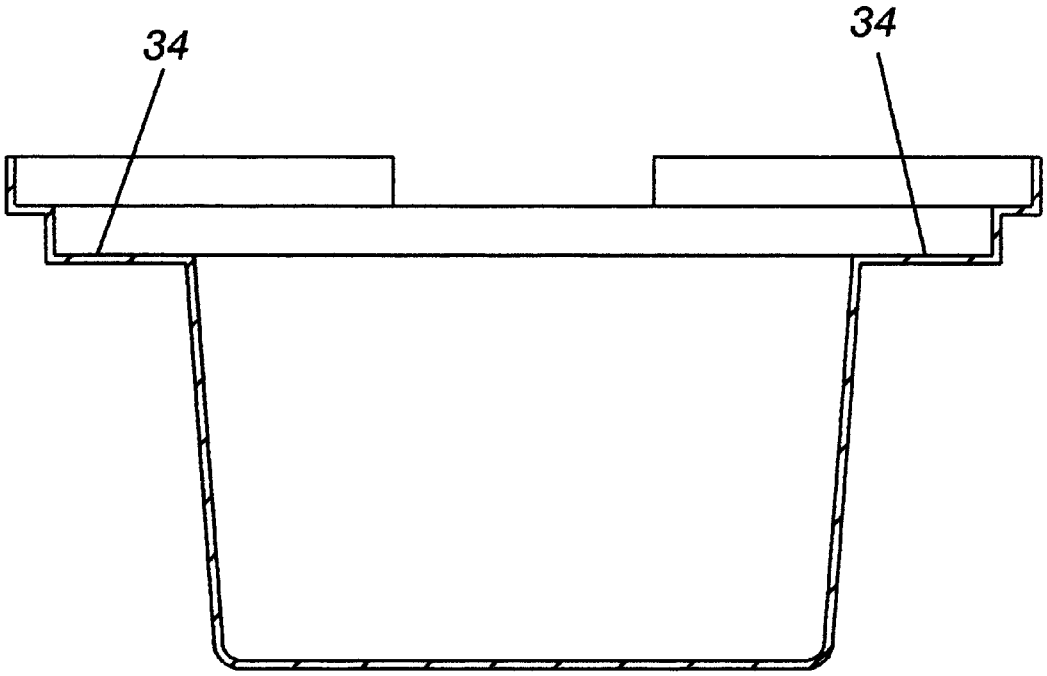
FIG. 19 is a cross section taken along line A—A of FIG. 18.
Figure 20:
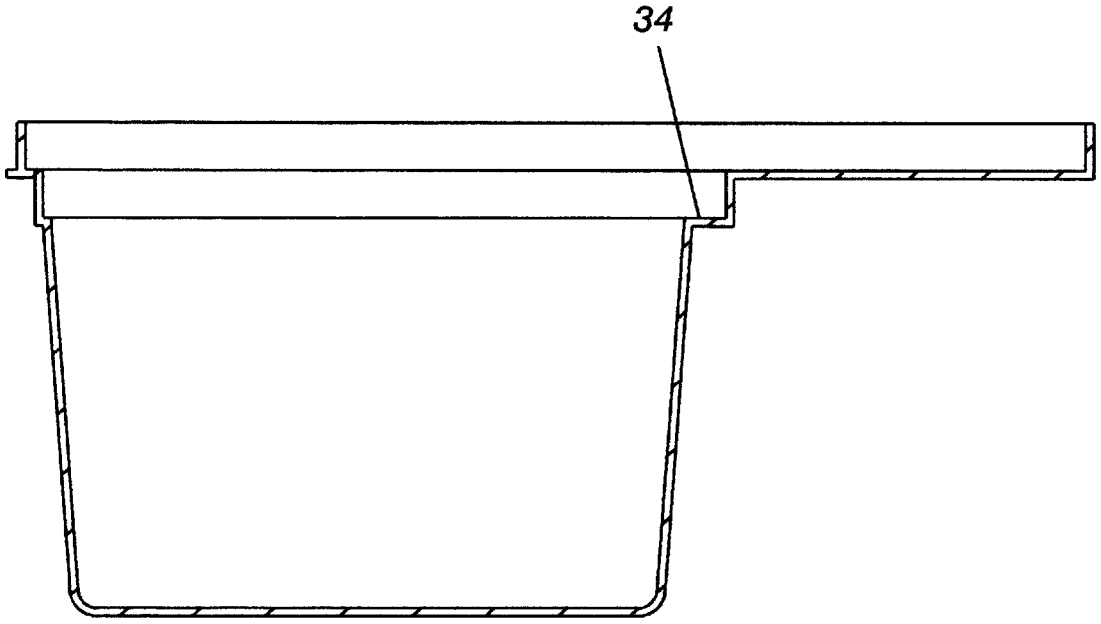
FIG. 20 is a cross section taken along line B—B of FIG. 18.

In operation, lid 50, as seen in FIG. 17, is sealably fastenable to lid engaging rim 60 and permits the storage of paint within painter's aid 10. Conventional paint can lid 150 may also be used to sealably store paint in painter's aid 10. When lid 50 is removed, a painter may then use painter's aid 10 for painting. Protrusion 52 aids in easy removal of lid 50.

SUMMARY OF THE ACHIEVEMENTS OF THE OBJECTS OF THE INVENTION

From the foregoing, it is readily apparent that I have invented an improved device that facilitates dripless painting, which includes a wiping surface to remove excess paint from a paint brush, and provides a sealable container for temporarily storing paint.

What is claimed is:

1. A painter's aid for sealably holding paint and for holding a paint brush having a brush portion and a handle portion, said painter's aid comprising:

a base;

a wall extending upwardly from said base, said wall comprising a front interior portion, a rear interior portion and a pair of opposed side wall portions tapering outwardly as they rise from said base and connecting said front interior portion and said rear interior portion;

upper ends of said pair of opposed side wall portions, connecting to said front interior portion and to said rear interior portion, said upper ends of said side walls portions tapering in separation width from said front interior portion to a lesser width at said rear interior portion;

a lid engaging rim opposite said base and integral with said wall, said upper end of said side wall portions having an upper step;

a platform for supporting the brush portion of the paint brush, said platform being generally parallel to said base and extending outwardly from said lid engaging rim; and a raised lip for supporting a paint brush, said lip being integral with said lid engaging rim and integral with and substantially upright to said platform, said lip having an opening therethrough adjacent said lid engaging rim and opposite said platform;

whereby paint on a paint brush is forced toward the center and top surface of the brush portion as the paint brush is moved across said tapering upper ends of said pair of opposed side wall portions.

2. A painter's aid according to claim 1 wherein said base is substantially flat.

3. A painter's aid according to claim 1 wherein said wall is integral with said base.

4. A painter's aid according to claim 1 wherein said opening of said lip is centrally positioned therethrough said lip.

5. A painter's aid according to claim 1 wherein said front interior portion is concave.

6. A painter's aid according to claim 1 wherein said rear interior portion is substantially flat.

7. A painter's aid according to claim 1 wherein said lid engaging rim is adapted to sealably engage a conventional paint can lid.

8. A painter's aid according to claim 1 further comprising a lid, said lid comprising a handle sized to extend therethrough said opening in said lip and a body sized to sealably engage said lid engaging rim.

9. A painter's aid according to claim 1 wherein said rear interior portion of said wall is connected to an interior oriented portion of a stepped wiping surface, said stepped wiping surface having a forward oriented portion connected to said upper step adjacent said platform.

10. A painter's aid according to claim 9 wherein said stepped wiping surface further includes a step and a riser.

11. A painter's aid according to claim 10 wherein said step and said riser are substantially perpendicularly positioned.

12. A painter's aid according to claim 10 wherein said step is inclined.

13. A painter's aid according to claim 9 wherein said stepped wiping surface is located between said platform and said rear interior portion of said wall, and said stepped wiping surface is at an elevation lower than said platform.

14. A painter's aid according to claim 13 wherein said stepped wiping surface is integral with said platform, said stepped wiping surface further comprises at least two steps, each of said stepped wiping surface is at a lower level than said platform.

15. A painter's aid according to claim 13 wherein said stepped wiping surface is integral with said rear interior portion of said wall, said stepped wiping surface further comprises a first stepped wiping surface adjacent said platform and having a width less than the width of said platform, and a second stepped wiping surface interior to said first stepped wiping surface, said second stepped wiping surface has a width larger than said first stepped wiping surface and less than the width of said platform, said second stepped wiping surface walls are adjacent said upper ends tapering of said opposed side wall portions of said rear interior portion of said wall.

16. A painter's aid according to claim 13 wherein said stepped wiping surface is adjacent with said upper step adjacent said platform, and said stepped wiping surface is adjacent said tapering upper ends of said opposed side wall portions at said rear interior portion of said wall.

17. A painter's aid according to claim 13 wherein said stepped wiping surface is adjacent with said rear interior portion, and adjacent with said upper ends tapering of said opposed side wall portions of said rear interior portion of said wall.

18. A painter's aid according to claim 1 wherein said raised lip is substantially perpendicular to said platform.

19. A painter's aid for sealably holding paint and for retaining a paint brush having a brush portion and a handle portion, said painter's aid comprising:

a base;

a wall extending upwardly from said base, said wall comprising a front interior portion, a rear interior portion and a pair of opposed side wall portions tapering outwardly from said base and connecting said front interior portion and said rear interior portion;

upper ends of said pair of opposed side wall portions, said upper ends opposite said base and formed by said pair of opposed side wall portions connecting said front interior portion to said rear interior portion, said upper ends tapering in separation width from said front interior portion to a lesser width at said rear interior portion;

a lid engaging rim opposite said base and integral with said wall;

a platform for supporting the brush portion of the paint brush, said platform being generally parallel to said base and extending outwardly from said lid engaging rim;

a stepped wiping surface, said stepped wiping surface has an outwardly oriented portion connected to said platform, said stepped wiping surface has an interior oriented portion connected to said rear interior portion; and a raised lip for supporting the handle portion of the paint brush, said lip being integral with said lid engaging rim and integral with and substantially upright to said platform, said lip having an opening therethrough adjacent said lid engaging rim and opposite said platform.

20. A painter's aid according to claim 19 wherein said stepped wiping surface is located between said platform and said rear interior portion of said wall, and said wiping surface is at a lower level than said platform, said stepped wiping surface includes steps at respectively lower levels than said platform, whereby said paint is forced toward the center and top surface of the brush portion as the paint brush is moved across said stepped wiping surface and across said upper ends of said pair of opposed side wall portions tapering in separation width to said lesser width at said rear interior portion.

* * * * *